US012422238B1

(12) United States Patent
Rankin

(10) Patent No.: US 12,422,238 B1
(45) Date of Patent: Sep. 23, 2025

(54) DEVICES, SYSTEMS, AND METHODS FOR RENDERING AMMUNITION INERT IN A NON-INVASIVE MANNER

(71) Applicant: John Rankin, Williamsport, OH (US)

(72) Inventor: John Rankin, Williamsport, OH (US)

(73) Assignee: Rankin Labs, LLC, Williamsport, OH (US)

( * ) Notice: Subject to any disclaimer, the term of this patent is extended or adjusted under 35 U.S.C. 154(b) by 0 days.

(21) Appl. No.: 18/760,365

(22) Filed: Jul. 1, 2024

Related U.S. Application Data

(60) Provisional application No. 63/524,463, filed on Jun. 30, 2023.

(51) Int. Cl.
*F42D 5/04* (2006.01)

(52) U.S. Cl.
CPC ..... *F42D 5/04* (2013.01)

(58) Field of Classification Search
CPC ..... F42D 5/04
See application file for complete search history.

(56) References Cited

U.S. PATENT DOCUMENTS

| | | | | |
|---|---|---|---|---|
| 6,487,950 | B2 * | 12/2002 | Samland | G01S 17/04 89/1.13 |
| 7,624,667 | B2 * | 12/2009 | Kilkis | F41H 11/12 89/1.13 |
| 9,242,708 | B2 * | 1/2016 | Cuschieri | B63G 7/08 |
| 10,060,716 | B2 * | 8/2018 | Creedican | G10K 11/348 |
| 2009/0107758 | A1 * | 4/2009 | Moore | G01N 33/227 374/45 |
| 2016/0161233 | A1 * | 6/2016 | Creedican | G10K 11/346 102/206 |
| 2021/0270992 | A1 * | 9/2021 | Radel | G01T 1/167 |

OTHER PUBLICATIONS

Slashdot, For the First Time, Scientists Have Fired Up the World's Smallest Particle Accelerators, article, Oct. 29, 2023, 6 pages.

* cited by examiner

*Primary Examiner* — Joshua E Freeman
(74) *Attorney, Agent, or Firm* — Standley Law Group LLP; Jeffrey S. Standley; Adam J. Smith

(57) ABSTRACT

Devices, systems, and methods for rendering ammunition inert in a non-invasive manner are provided. Ultrasonic waves are emitted by way of one or more ultrasonic emitters toward an area with the ammunition sufficient to agitate propellant of the ammunition. Positron waves are generated and emitted by way of one or more positron emitters toward the area sufficient to bond at least a majority of carbon atoms in the propellant of the ammunition.

20 Claims, 4 Drawing Sheets

DEVICES, SYSTEMS, AND METHODS FOR RENDERING AMMUNITION INERT IN A NON-INVASIVE MANNER

CROSS-REFERENCE TO RELATED APPLICATIONS

This application claims the benefit of U.S. Application Ser. No. 63/524,463 filed Jun. 30, 2023, the disclosures of which are hereby incorporated by reference as if fully restated herein.

TECHNICAL FIELD

Exemplary embodiments relate generally to devices, systems, and methods for rendering ammunition, such as for firearms, inert in a non-invasive manner.

BACKGROUND AND SUMMARY OF THE INVENTION

A large number of firearms exist in circulation and have contributed to violent events. Sometimes even despite precautions, firearms are present at places where they are not supposed to be and/or possessed by persons not authorized to be in such possession at the given time and/or location. Conventional techniques for firearm detection generally involve invasive techniques such as manual searching (e.g., pat downs) or less/non-invasive techniques such as metal detection, x-rays, and gunpowder residue testing. Individuals tend to resist these techniques due to privacy concerns, and these techniques are not perfect. Even if a firearm or other contraband is detected using such techniques, the situation must be handled carefully as the firearm or other contraband generally remains useable. This may result in a violent escalation or event at, before, or even after a security checkpoint. In view of these deficiencies, and others, what is needed is a non-invasive ability to render contraband ineffective.

Devices, systems, and methods for rendering ammunition inert in a non-invasive manner are provided. As used herein, non-invasive may also refer to generally less invasive techniques.

Ammunition generally comprises a propellent placed within a casing which includes a projectile. For many types of projectiles, such as bullets, for many types of firearms, ammunition comprises gunpowder placed within a casing. Gunpowder generally comprises a mixture comprising charcoal, the charcoal providing carbon and other fuel for a reaction necessary to propel the projectile.

The present invention may involve exposing the gunpowder to ultrasonic waves which agitate the explosive material and subsequently, or simultaneously, exposing the mixture to positron waves of sufficient dosage to bond at least a significant amount (e.g., >50%) of the carbon atoms within the ammunition casing. The ultrasonic waves may be alternated with the positron waves, the ultrasonic waves may be consistently provided over a period of time with periodic positron waves, the positron waves may be consistently provided over a period of time with period ultrasonic waves, combinations thereof, or the like. Regardless, bonding of the carbon atoms may cause the ammunition to burn relatively slowly, if at all, thereby rendering the ammunition wholly or effectively inert. For example, the ammunition, when used, may experience a relatively slow expansion such that the projectile is exposed to insufficient force to leave the casing and/or leaves the casing with significantly reduced speed.

Regarding the positron emission, electrons are generally negatively charged, and are either freely moving or part of an atom. Positively charged electrons are generally found or produced to be freely moving, and not part of an atom. When a positively charged electron (positron) comes in contact with a negatively charged electron, they generally act to eliminate the existence of both. This is true for freely moving electrons as well as electrons that make up part of an atom. When an electron is eliminated from an atom, it generally changes the structure and operation of the atom and how it bonds with other materials.

Positron emission, beta plus decay, or β+ decay is a subtype of radioactive decay called beta decay, in which a proton inside a radionuclide nucleus is converted into a neutron while releasing a positron and an electron neutrino (ve). Positron emission is mediated by the weak force. The positron is a type of beta particle (β+), the other beta particle being the electron (β−) emitted from the β− decay of a nucleus.

An example, without limitation, of positron emission (β+ decay) is magnesium-23 decaying into sodium-23. Because positron emission generally decreases proton number relative to neutron number, positron decay happens typically in large "proton-rich" radionuclides. Positron decay generally results in nuclear transmutation, changing an atom of one chemical element into an atom of an element with an atomic number that is less by one unit. Positron emission rarely occurs naturally on earth, such as when induced by a cosmic ray or from one in a hundred thousand decays of potassium-40, a rare isotope, 0.012% of that element on earth. Positron emission is different from electron emission or beta minus decay (β− decay), which occurs when a neutron turns into a proton and the nucleus emits an electron and an antineutrino. Positron emission is different from proton decay, the hypothetical decay of protons, not necessarily those bound with neutrons, not necessarily through the emission of a positron, and not as part of nuclear physics, but rather of particle physics.

Gunpowder is generally a granular mixture of: a nitrate, typically potassium nitrate (KNO3), which supplies oxygen for the reaction; charcoal, which provides carbon and other fuel for the reaction, simplified as carbon (C); sulfur (S), which, while also serving as a fuel, lowers the temperature required to ignite the mixture, thereby increasing the rate of combustion; and potassium nitrate, which is potentially the most important ingredient in terms of both bulk and function because the combustion process releases oxygen from the potassium nitrate, promoting the rapid burning of the other ingredients. To reduce the likelihood of accidental ignition by static electricity, the granules of modern gunpowder are typically coated with graphite, which prevents the build-up of electrostatic charge.

Charcoal does not generally consist of pure carbon; rather, it comprises partially pyrolyzed cellulose, in which the wood is not completely decomposed. Carbon differs from ordinary charcoal. Whereas charcoal's autoignition temperature is relatively low, carbon's is generally much greater. A gunpowder composition containing pure carbon would likely burn similarly to a match head.

The current standard composition for the gunpowder manufactured by pyrotechnicians was adopted long ago. Proportions by weight generally include, about, 75% potassium nitrate (known as saltpeter or saltpetre), 15% softwood charcoal, and 10% sulfur by weight. These ratios vary over time and geography, for example, and can be altered somewhat depending on the purpose of the powder. For instance, power grades of black powder, generally unsuitable for use in firearms but adequate for blasting rock in quarrying operations, are sometimes called blasting powder rather than gunpowder with general proportions of about 70% nitrate, 14% charcoal, and 16% sulfur by weight. While blasting powder may be made with less expensive sodium nitrate substituted for potassium nitrate and proportions may be as low as 40% nitrate, 30% charcoal, and 30% sulfur by weight. For certain blasting powders, after manufacturing grains from press-cake in the usual way, the powder is tumbled with graphite dust, such as for about 12 hours to form a graphite coating on the grains and reduced its ability to absorb moisture.

In exemplary embodiments, without limitation, a system for rendering ammunition inert includes at least one ultrasonic emitter for agitating the ammunition, or portions thereof, and at least one positron emitter for emitting positrons towards the ammunition to render it inert. The ultrasonic emitter and/or positron emitter may be operatively controlled by a controller. In exemplar embodiments, without limitation, one or more sensors may be electronic communication with the controller, such as for detecting nearby objects, such as humans and/or objects of specific type (e.g., metal detection). Where certain objects are detected, the ultrasonic emitter and/or positron emitter may be automatically activated, for example. Alternatively, or additionally, the controller may be in electronic communication with a user interface for controlling operations of the ultrasonic emitter and/or positron emitter.

The positron emitter may be connected to a positron source, such as but not necessarily limited to, a cyclotron for generating positrons and/or a hot cell for storing radioactive isotopes, which decay into positrons. A guiding column comprising charged plates may be positioned adjacent to the positron emitter to direct the positions towards a target, such as ammunition.

Some or all such components may provided within a common housing, such as to provide a portable device, or may be remote from one another and connected by wired and/or wireless connection, such as to facilitate remote control.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1A:
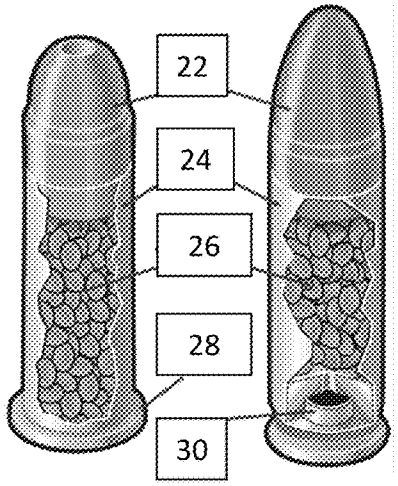
FIGURE 1A (prior art)
FIG. 1A is a cutaway view of an exemplary bullet.
Figure 1B:
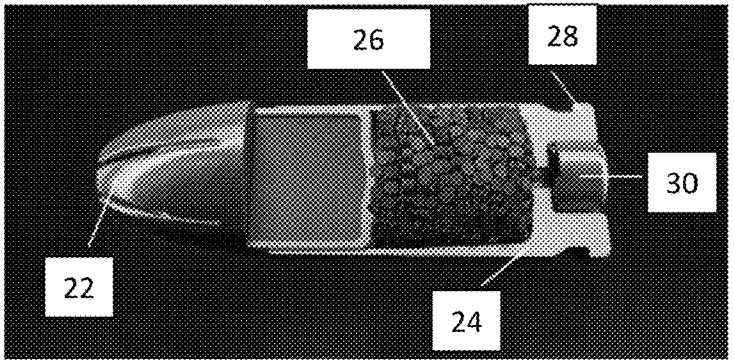
FIGURE 1B (prior art)
FIG. 1B is a cutaway view of another exemplary bullet.
Figure 1C:
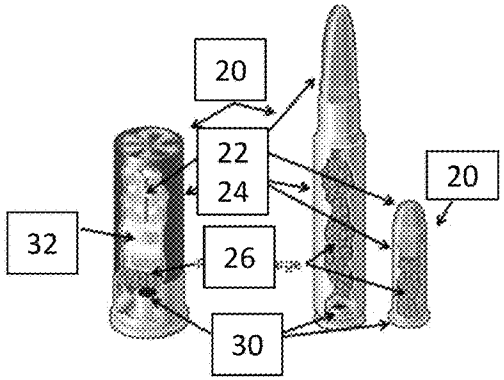
FIGURE 1C (prior art)
FIG. 1C is a cutaway view of other exemplary projectiles.

FIG. 1A through FIG. 1C illustrate various known, exemplary ammunition 20. The ammunition 20 may include a projectile 22, such as a bullet. A casing 24 may secure the projectile 22 until firing along with a propellant 26 and/or a primer 30. Propellent 26, such as gunpowder, may be stored within the casing 24. The propellant 26 generally comprises at least a majority of carbon by molecular weight. The propellant 26 may be activated by a primer 30, which may in turn be activated by physical striking, such as by way of a hammer or other mechanism. The primer 30 may be provided at a rim (rimfire) and/or at a center of a bottom of the casing 24 (centerfire), for example. Various type and kinds of ammunition 20 are known, such as in various sizes (calibers) for various type and kinds of firearms (e.g., pistols, shotguns, rifles, machine guns, artillery, combinations thereof, or the like. Alternatively, or additionally, various explosives are known which utilize various propellants 26, such as gunpowder, in various forms, compositions, amounts, and the like.

In order to render a firearm unusable, one option is to disable, or substantially render inert, its ammunition 20. Many firearms use a type of ammunition 20 that is based upon a relatively similar design. Generally, the propellant 26 comprising gunpowder, or black powder, which is essentially a low-grade explosive, contained within a hollow structure, such as a casing 24. The casing 24, for example, may comprise brass, metal, or copper. This explosive 26 is ignited, such as by way of a primer 30, and the rapid expansion of gases produces sufficient pressure to expel a projectile 22. This is often a bullet. However, this general design for ammunition 20 may be provided in a wide variety of embodiments with a wide variety of specific components. Whatever the specific embodiment, ammunition 20 generally comprise the same basic elements: a casing 24, an explosive 26 within the casing 24, an ignition means 30, and a projectile 22 that will be violently pushed out of the casing 24 based upon the expansion of gases from the explosion. To be effective, the casing 24 generally must be strong enough to contain the explosion and force the projectile 22 out in a directed path.

If the projectile 22 holds a stronger barrier than the rest of the casing 24, then the ammunition 20 will generally fail, as the explosion will burst the seams of the casing 24 and generally fail to expel the projectile 26. Alternatively, the ignition means 30 fails to ignite the propellent 26, then there will be no rapid expansion of gases, and again the projectile 22 will generally fail to be expelled. Alternatively, if the explosive merely burns, rather than producing an accelerated action, then the expansion of gases will not be rapid and there will generally be insufficient pressure to expel the projectile 22 or the projectile 22 will be expelled with relatively low speed. Any of these approaches may potentially render ammunition 20 inert. The present invention may render ammunition 20 by one or all such approaches and outcomes. While failing to expel the projectile 22 is generally discussed herein, those of skill in the art will also recognize that substantially the same effect may be achieved by allowing the projectile 22 to expel with only a relatively small amount of speed or any of the other aforementioned approaches and outcomes.

Focusing on the principles behind how the propellant 26, usually gunpowder, functions, ammunition 20, explosives 26 are generally a combination of several chemicals, that when combined, produce the desired effect. For illustration gunpowder is discussed, however, other types of propellants 26 may be used, which generally follow the same basic process.

As the charcoal burns it releases gases. However, if the charcoal does not burn at a sufficiently rapid pace, then the gases will not expand at a rate that will produce sufficient pressure to provide the desired result, such as expel the projectile 22, expel the projectile 22 at least at a desired speed, and/or cause an explosion of sufficient magnitude.

Examining the process where charcoal is burning by analogy, if one ignites a pool of gasoline, it will generally not explode as may happen within an engine but will instead merely burn. This is true because only the molecules of gasoline laying on top of the pool that are exposed to oxygen will burn, as oxygen is a necessary element for ignition. However, if gasoline is compressed in a chamber, and mixed with oxygen, as is the case within a piston cylinder of an internal combustion engine, the gasoline will expand rapidly. This is due to the presence of oxygen surrounding more molecules than just the ones along the surface. This is the same for the explosive used in ammunition.

Since gunpowder is a granular mixture, the potassium nitrate and the charcoal are generally dispersed throughout the mixture, and therefore an oxygen source is available for more than just a few molecules of charcoal. If, however, the charcoal was a solid mass, no explosion is likely to occur, because only the molecules on the surface of the solid would generally burn. This would not produce a rapid expansion of gases, and no explosion is likely to occur. In the case of gunpowder, the charcoal, which is granular, is ignited and as it draws oxygen from the potassium nitrate, other charcoal molecules are nearly simultaneously ignited and begin to burn before the first charcoal molecule has been used up. No matter how compact the gunpowder, the principles are generally the same. Gunpowder explodes because the charcoal is mixed with a source of oxygen.

Figure 2:
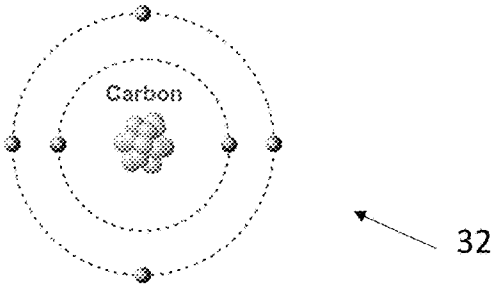
FIGURE 2 (prior art)
FIG. 2 is a simplified molecular diagram of an exemplary carbon atom.

Turning to carbon, the carbon atom 32, such as illustrated in FIG. 2, is essentially unique among elements in its tendency to form extensive networks of covalent bonds not only with other elements but also with itself. Because of its position midway in the second horizontal row of the periodic table, carbon is neither an electropositive nor an electronegative element; it therefore is more likely to share electrons than to gain or lose them. Moreover, of all the elements in the second row, carbon has the maximum number of outer shell electrons (four) capable of forming covalent bonds. Other elements, such as phosphorus [P] and cobalt [Co], are able to form five and six covalent bonds, respectively, with other elements, but they lack carbon's ability to bond indefinitely with itself. When fully bonded to other atoms, the four bonds of the carbon atom 32 are directed to the corners of a tetrahedron and make angles of about 109.5° with each other. As a result, not only can carbon atoms 32 combine with one another, essentially indefinitely, to give compounds of extremely high molecular weight, and the molecules formed can exist in an essentially infinite variety of three-dimensional structures. The possibilities for diversity are increased by the presence of atoms other than carbon in organic compounds, especially hydrogen (H), oxygen (O), nitrogen (N), halogens (fluorine [F], chlorine [Cl], bromine [Br], and iodine [I]), and sulfur (S). It is the enormous potential for variation in chemical properties that has made organic compounds essential to life on Earth.

Figure 3:
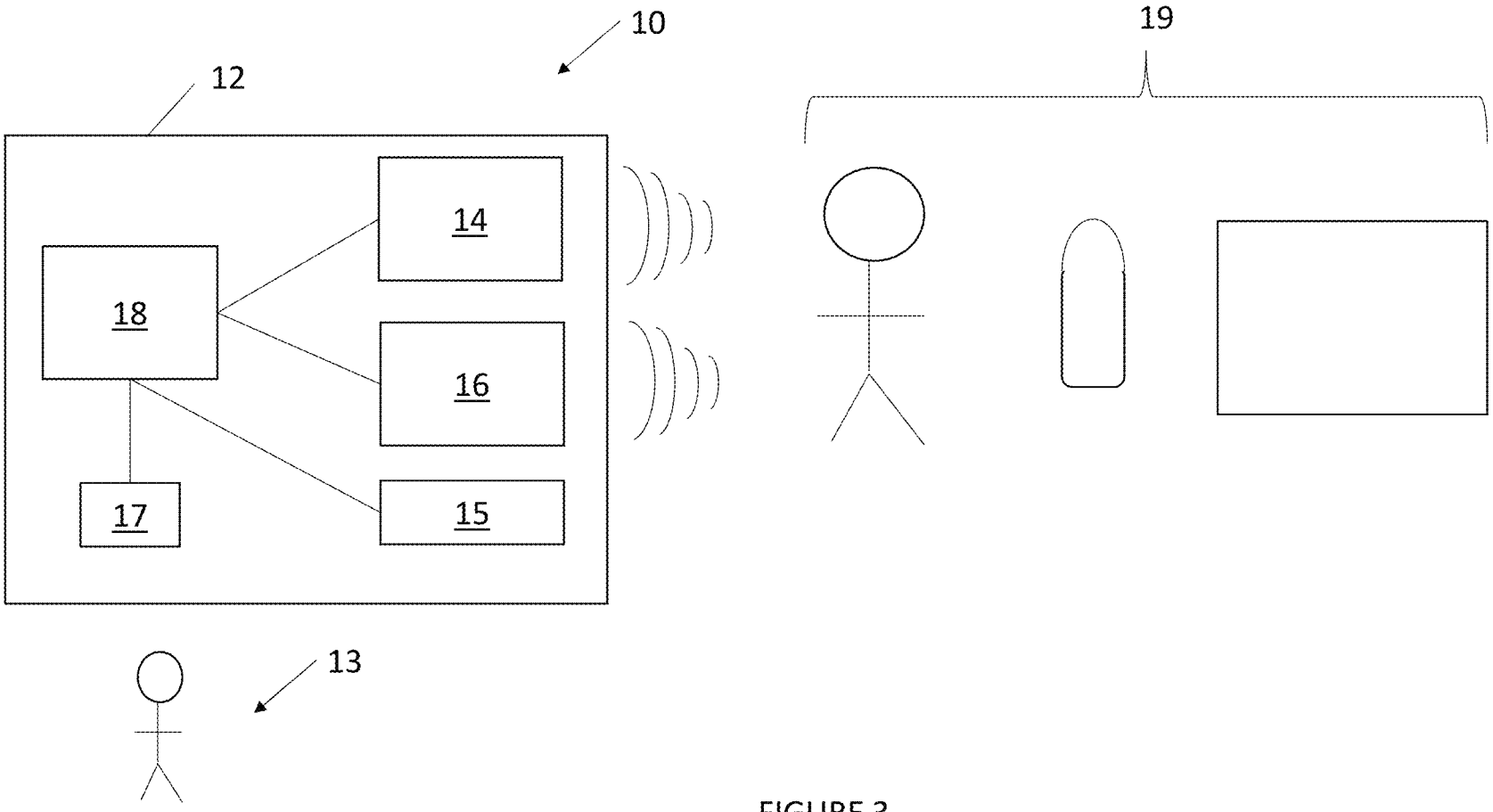
FIG. 3 is plan view of an exemplary device and system in accordance with the present invention in exemplary use.

FIG. 3 illustrates a system 10 for rendering ammunition inert in accordance with the present invention. The system 10 may comprise one or more ultrasonic sound wave emitters ("ultrasonic emitters") 14. The ultrasonic emitters 14 may be configured to selectively emit ultrasonic sound waves. The system 10 may comprise one or more positron emitters 16. The positron emitters 16 may be configured to selectively generate and emit positrons, such as in one or more waves. The ultrasonic emitter(s) 14 and positron emitter(s) 16 may be in electronic communication with a controller 18, which may be configured to selectively operate the ultrasonic emitter(s) 14 and positron emitter(s) 16, such as to cause ultrasonic wave and/or positron wave emission of controlled and/or predetermined dosage (e.g., wave height, wave length, number of waves, time of exposure, wave frequency, combinations thereof, or the like).

The system 10 may comprise one or more sensors 15. The sensor(s) 15 may comprise proximity sensors, distance sensors, lasers, cameras and/or image recognition software, optical sensors (e.g., lasers, photodetectors), magnets, metal detectors, magnetic field detectors, combinations thereof, or the like. The sensor(s) 15 may be configured to detects persons or other objects 19 within a detection area proximate the system 10. The detection may comprise, consist of, and/or overlap with an emission area for one or both of the ultrasonic emitter(s) 14 and the positron emitter(s) 16.

The sensor(s) 15 may be in electronic communication with the controller 18. The controller 18 may be configured to receive and/or interpret data from the sensor(s) 15. In exemplary embodiments, without limitation, the controller 18 may be configured to automatically operate the ultrasonic emitter(s) 14 and/or positron emitter(s) 16 based on data received from the sensor(s) 15. For example, without limitation, the controller 18 may be configured to automatically activate the ultrasonic emitter(s) 14 and/or positron emitter(s) 16 when data is received from the sensor(s) 15 indicating the presence of objects 19 (generally of a predetermined type—e.g., human, ammunition, container, though such is not required) within the detection area.

The system 10 may comprise one or more user interfaces 17. The user interface(s) 17 may comprise control panel(s), such as comprising and/or in the form of one or more buttons, touch screens, levers, combinations hereof, or the like. The user interface(s) 17 may be configured for actuation by a user 13, such as but no limited to a security officer.

The user interface(s) 17 may be in electronic communication with the controller 18. The controller 18 may be configured to receive and/or interpret data from the user interface(s) 17. In exemplary embodiments, without limitation, the controller 18 may be configured to operate and/or adjust operations of the ultrasonic emitter(s) 14 and/or positron emitter(s) 16 upon actuation of certain controls at the user interface(s) 17. For example, without limitation, the controller 18 may be configured to automatically activate the ultrasonic emitter(s) 14 and/or positron emitter(s) 16 when data is received from the user interface(s) 17 requesting operation. Alternatively, or additionally, various operations may be ceased and/or adjusted (e.g., wave characteristics, timing, etc.).

Some or all of the system 10 components (e.g., ultrasonic emitter(s) 14, positron emitter(s) 16, controller 18, sensor(s) 15, and/or user interface(s) 17 may be provided within a common housing 12 or multiple housings 12. At least portions of the housing 12 may be substantially (e.g., >80%) transparent to ultrasonic signals and/or positrons. Alternatively, or additionally, portions of the ultrasonic emitter(s) 14 and/or positron emitter(s) 16 may be at least partially exposed.

The electronic connections may be wired and/or wireless, such as to permit certain components of the system 10 to be non-local and/or remotely operated and/or adjusted. Network communication devices may be provided to support the same.

Some or all of the system 10 components may be, optionally, disguised. For example, without limitation, the system 10 components may be disguised within building entrances, hallways, security checkpoints, combinations thereof, or the like. The housing 12 may comprise such portions of building entrances, hallways, security checkpoints, combinations thereof, or the like.

Figure 4:
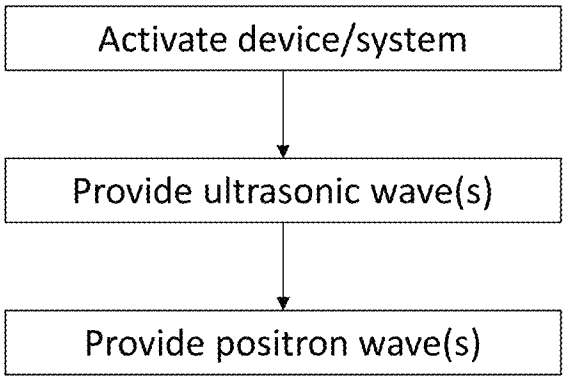
FIG. 4 is a flow chart with exemplary logic for operating the device and system of FIG. 3 in accordance with the present invention.

FIG. 4 provides exemplary operation of the system 10. The system 10 may be activated manually (e.g., by user interface 17) and/or automatically (e.g., by sensor 15). Once activated, one or multiple doses of ultrasonic waves may be emitted by the ultrasonic emitter(s) 14 and one or multiple doses of positrons may be generated and emitted by the positron emitter(s) 16. The system 10 may be configured to provide the ultrasonic waves before and/or simultaneous with the positrons. In other exemplary embodiments, without limitation, the system 10 may be configured to alternate the ultrasonic waves with the positron waves, provide the ultrasonic waves consistently and periodically provide the positron waives, consistently provide the positron waves and periodically provide the ultrasonic waves, combinations thereof, or the like. For example, without limitation, alternating the ultrasonic waves may allow the positron emissions to bond with the carbon while the material is stable. As another example, without limitation, maintaining a continual ultrasonic wave may maximize the movement of the carbon being bonded. Transmissions of the ultrasonic waves and/or positrons may continue until at least 75% of the carbon material is bonded, though higher thresholds may be utilized (e.g., 90%, 95%, 99%, etc.).

Carbon generally has six electrons and four of them are in its outer layer. If a carbon atom 32 has only three electrons in its outer layer, it tends to bond with an adjacent carbon atom 32, sharing the electron between the atoms and forming a bond. When a positively charged electron (positron), comes in contact with a carbon atom 32, it generally eliminates one of the electrons in the outer layer, and allows the carbon atom 32 to more easily bond with an adjacent carbon atom 32.

The propellant 26 within the ammunition 20 casing 24 generally comprises a number of chemicals that have been mixed, rather than bonded. In the example of gunpowder, these chemicals generally are: potassium nitrate, charcoal, and sulfur. Since they are mixed the carbon atoms 32 are not necessarily adjacent to each other, as they may be separated by one or two of the other mixed chemicals. Therefore, by presenting an ultrasonic sound wave, such as by way of the ultrasonic emitter(s) 14, the mixed propellant 26 will vibrate and cause the chemicals to change position. As the chemicals move, carbon atoms 32 periodically come in contact, as the chemicals are exchanged in their position. While the mixture is in motion, a wave of freely moving positrons, such as emitted by way of the positron emitter(s) 16, will cause electrons from the outer layer of the carbon atoms 32 to be eliminated. By placing these altered carbon atoms 32 in motion, they may periodically come in contact and may bond with any carbon atom 32 that they become adjacent with. As this process continues, more and more carbon atoms 32 may become bonded to a building mass, and eventually form into a solid, or substantially solid (e.g., >70%) structure.

Once some or all of the carbon within the explosive 26 has formed into a mass, and is no longer sufficiently mixed, it will no longer explode and/or provide sufficient propulsion to the projectile 22. For the chemical mixture to explode it must have fuel, or carbon, as well as a source of oxygen. While the source of oxygen likely remains, only any carbon in the outer layer of the solid, or substantially solid, mass will likely burn, and this will happen relatively slowly. A solid form of fuel generally burns relatively slowly, while a mixed form generally burns relatively rapidly. While this will still produce gases, the gas expansion will be significantly less than intended. The pressure produced will generally loosen the hold that the casing 24 has on the projectile 22, and allow the gases to escape without producing a force necessary for ejection and/or violent ejection. In this way, the ammunition 20 will essentially have been rendered harmless.

The positron emitter(s) 16 may utilize any one or more known and/or yet developed techniques, such as but not limited to: proton collisions, beta decays, electromagnetic showers initiated by energetic gamma rays or electrons, muon decays, pion and other hadron decays, and/or electromagnetic nuclear decays. In exemplary embodiments, without limitation, the positron emitter(s) 16 may comprise a radioactive source which emits positrons. Alternatively, or additionally, the positron emitter(s) 16 may comprise a high energy beam which is aimed at a target as well as magnets to collect, cool, and direct the positrons. The ultrasonic emitter(s) 14 may comprise one or more commercially available ultrasonic emitters.

Positrons may be delivered by way of radioactive isotopes. However, radioactive isotopes are generally unstable and not widely available in their natural form; therefore, a cyclotron may be utilized to provide an isotope. A cyclotron accelerates particles (such as hydrogen atoms) to very high speeds and focuses those high speed particles on a target substance where a reaction takes place upon collision therewith that produces a radioactive element. Both the accelerated particles and target substance are specifically chosen to produce the desired radioactive element.

Once produced in the cyclotron, the radioactive material may be transferred to a shielded "hot cell." The medical field generally processes these isotopes through sophisticated chemistry modules to produce biological tracers. These tracers can be used in medical imaging to more accurately diagnose and manage disease, for example. The main isotope produced by BC Cancer's cyclotron is Fluorine-18 (F-18), for example. This is used in the tracer Fluorodeoxyglucose (FDG); which maps glucose metabolism in the body. F-18 is a radioactive isotope that decays through the emission of positrons. These positrons are the key to Positron Emission Tomography (PET) scans that are used daily around the world for cancer diagnosis and cancer treatment planning. In addition to producing F-18, BC Cancer also produces other radioactive isotopes such as Carbon-11 (C-11), Gallium-68 (Ga-68), andTechnetium-99m (Tc-99m) for medical imaging studies. Nitrogen-13 (N-13) is also produced as a by-product in making some of these isotopes.

The following table illustrates, in an exemplary fashion, the commonly produced isotopes that are used in medical PET scans. It is far from a comprehensive list, nor the only method of producing radioactive isotopes:

TABLE 1

| Isotope | Half-Life | 1 Hour | 3 Hours | 1 Day | 3 Days | 1 Month |
|---|---|---|---|---|---|---|
| N-13 | 10 Minutes | 2% | 0% | 0% | 0% | 0% |
| C-11 | 20 Minutes | 13% | 0% | 0% | 0% | 0% |
| Ga-68 | 68 Minutes | 54% | 16% | 0% | 0% | 0% |
| F-18 | 110 Minutes | 69% | 32% | 0% | 0% | 0% |
| Tc-99m | 6 Hours | 89% | 71% | 6% | 0% | 0% |
| Zr-89 | 3.3 Days | 99% | 97% | 81% | 53% | 0% |

Once an isotope has been produced and transferred to a shielded "hot cell," it generally has a radioactive half-life that is related to the emission of positrons that the materials are producing. Since there are many medical uses for these isotopes, such as in a PET scan, hospitals typically obtain "hot cells" from either suppliers or cyclotrons maintained within the hospital. These same sources can be used by and/or for the devices, system, and/or methods described herein by way of non-limiting example, and may (optionally) be discharged prior to the expiration of their half-life. Furthermore, modern cyclotrons are compact and portable, and have been produced in relatively extremely small sizes in recent times (e.g., Fermilab employee Chris Olsen built a cyclotron approximately eight centimeters in diameter). E.g., https://science.slashdot.org/story/23/10/29/1638225/for-the-first-time-scientists-have-fired-up-the-worlds-smallest-particle-accelerators.

Figure 5:
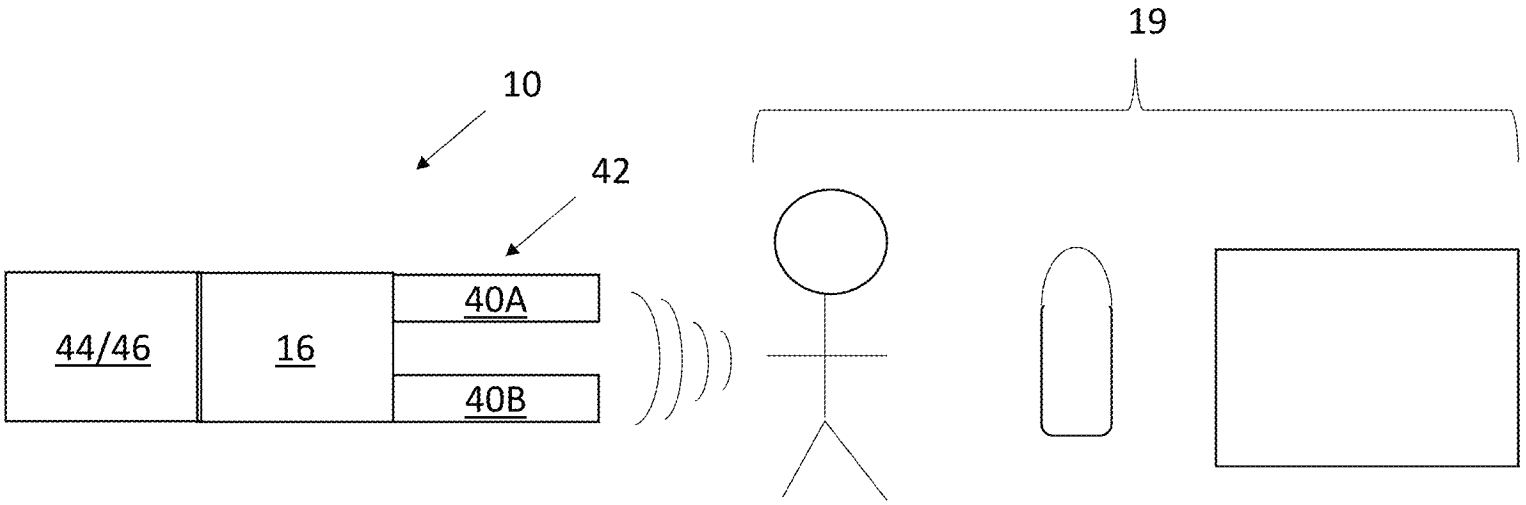
FIG. 5 is a detailed view of an exemplary positron emitter and guiding column for the device and system of FIG. 3 and/or method of FIG. 4 in exemplary use.

As illustrated with particular regard to FIG. 5 by way of non-limiting example, this means that such cyclotrons 44 and/or hot cells 46 may be provided in sufficiently small sizes to be placed within the housing 22 of the device 10, which may be portable, by way of non-limiting example. The cyclotrons 44 and/or hot cells 46 may be part of the positron emitters 16 or separate therefrom.

Radioactive isotopes, such as produced by the cyclotrons 44 and/or stored at the hot cells 46, may be used to produce positrons for use with the positron emitters 16 or other system 10 components. Since the positrons are positively charged, they may be guided out of the positron emitter 16 in a direction by way of a guiding column 42. The guiding column 42 in exemplary embodiments, without limitation, is positioned adjacent to the positron emitter 16 or forms part thereof. For example, without limitation, the guiding column 42 may be positioned adjacent to the cyclotrons 44 and/or the hot cells 46 to guide positrons emitted therefrom. The guiding column 42 may comprises one or more negatively charged plates 40A, 40B. The plates 40 may be arranged into a generally hollow cuboid or cylindrical shape by way of non-limiting example, to control the direction of the wave of positrons emitted by the positron emitter 16. The guiding column 42 may protrude from the housing 12 or be internal thereto.

The system 10 may be designed in one of three exemplary ways, without limitation: first, it can be configured to hold the hot cell 46 for emission; second, the positron emitter 16 may be connected to a portable cyclotron 44, where the isotopes are directed into the guiding column 42 for direct emission rather than stored within the hot cell 46; third, a miniature cyclotron 42 may be contained within the device itself (e.g., within housing 12), so that radioactive isotopes can be produced, organized, and directed into the directional chamber 42 without requiring any external connection of transportation of the hot cells 46. Furthermore, depending upon the half-life of the isotope selected, the system 10 may be charged prior to use, so that it may operate in a self-contained manner until the isotope has sufficiently discharged.

Since radioactive isotopes continually produce positrons as a result of the isotopes' half-life decay, when the system 10 is not in operation the hot cell 46 may be configured to allow the positrons to dissipate without exiting the housing 12, for example, such as by way of shielding and/or charged plates which keeps the positrons within the housing 12. Furthermore, the shorter the half-life of the radioactive isotope, the larger the amount of positrons are emitted; therefore, with a smaller stream of positrons, the system 10 will need to maintain a longer exposure to produce the desired effect upon the ammunition 20. If the device 10 is configured to produce isotopes internally, it may be configured to use a wide range of materials, and thus isotopes with shorter half-lives may be more desirable.

Since this process can be accomplished with two or more types of waves, such as ultrasonic sound waves, and positron waves, this process may be operated from a distance from the objects 19. This may permit penetration of various depths into objects 19. In this way, for example without limitation, the ammunition 20 within a firearm or an ammunition clip may be rendered inert. This will essentially render any firearm in which the ammunition 20 is used ineffective. In order to return the firearm to a working condition, new ammunition 20 must be obtained. Ultrasonic and positron waves are capable of traveling long distances, and passing through other materials; therefore, this process can be used to disable ammunition 20 in a wide range of situations and circumstances.

The controller 18 may be configured to adjust operations of the ultrasonic emitter(s) 14 and/or the positron emitter(s) 16. For example, the controller 18 may adjust wave characteristics (e.g., amplitude, magnitude, frequency, number, combinations thereof, or the like), such as on an automated basis, based on a distance to the object 19, type of object 19, user preferences, combinations thereof, rot he like. Such adjustments may be made based on the data from the sensors 15 and/or the user interface 17.

While ammunition 20, such as for firearms, is discussed in many instances. The disclosed devices, systems, and methods may be used for various, particularly primarily carbon-based, explosives, such as but not limited to, bombs, artillery shells, improvised explosive devices, combinations thereof, or the like.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention.

Certain operations described herein may be performed by one or more electronic devices. Each electronic device may comprise one or more processors, electronic storage devices, executable software instructions, combinations thereof, and the like configured to perform the operations described herein. The electronic devices may be general purpose computers or specialized computing devices. The electronic devices may comprise personal computers, smartphone, tablets, databases, servers, or the like. The electronic connections and transmissions described herein may be accomplished by wired or wireless means. The computerized hardware, software, components, systems, steps, methods, and/or processes described herein may serve to improve the speed of the computerized hardware, software, systems, steps, methods, and/or processes described herein. The electronic devices, including but not necessarily limited to the electronic storage devices, databases, controllers, or the like, may comprise and/or be configured to hold, solely non-transitory signals.

What is claimed is:

1. A method for rendering ammunition inert in a non-invasive manner, said method comprising:

emitting ultrasonic waves by way of one or more ultrasonic emitters toward an area with the ammunition sufficient to agitate propellant of the ammunition; and generating and emitting positron waves by way of one or more positron emitters toward the area sufficient to bond at least a majority of carbon atoms in the propellant of the ammunition.

2. The method of claim 1 wherein:

at least some of the ultrasonic waves and the positron waves are emitted simultaneously.

3. The method of claim 2 wherein:

the ultrasonic waves are emitted continuously for a period of time; and the positron waves are emitted during the period of time.

4. The method of claim 1 wherein:

at least some of the ultrasonic waves and the positron waves are alternately emitted.

5. The method of claim 1 further comprising:

placing an object at the area;

receiving, at a controller in electronic communication with the one or more ultrasonic emitters and the one or more positron emitters, data; and in response to receiving the data, commanding, by way of the controller, the emission of the ultrasonic waves at the one or more ultrasonic emitters towards an area and the generation and emission of the positron waves at the one or more positron emitters towards the area.

6. The method of claim 5 wherein:

the data is received from one or more sensors in response to detection of the object within the area.

7. The method of claim 6 wherein:

the one or more sensors comprise at least one of: a proximity sensor, a metal detector, and a camera.

8. The method of claim 6 wherein:

the one or more sensors comprise a range finder; and the controller is configured to automatically adjust at least one of a number, magnitude, and amplitude of the waves from at least one of the ultrasonic emitters or the positron emitters based on a distance to the object derived from the data.

9. The method of claim 5 wherein:

the data is received from a user interface in response to manual actuation by a user.

10. The method of claim 5 wherein:

the object comprises at least one of: ammunition, suspected ammunition, a firearm, a suspected firearm, a bomb, an ammunition clip, a container, and a person.

11. The method of claim 1 wherein:

the ultrasonic waves and the positron waves are sufficient to bond at least 95% of the carbon atoms of the propellant in the ammunition.

12. The method of claim 1 wherein:

the positron emitter comprises a housing, a directional chamber positioned adjacent to the housing comprising charged plates, and at least one of: a hot cell for holding and a cyclotron for generating radioactive isotypes for generating the positrons is located within the housing.

13. The method of claim 12 wherein:

the directional chamber is shaped as a hollow cylinder.

14. A system for rendering ammunition inert in a non-invasive manner, said system comprising:

a positron emitter;

an ultrasonic emitter;

a controller in electronic communication with the positron emitter and the ultrasonic emitter, said controller configured to:

receive data for initiating of the system;

cause the ultrasonic emitter to emit one or more waves of ultrasonic sound toward an area; and cause the position emitter to generate and emit one or more waves of positrons toward the area.

15. The system of claim 14 further comprising:

one or more sensors in electronic communication with the controller, wherein the data is received from the one or more sensors in response to detection of an object within the area.

16. The system of claim 14 further comprising:

one or more sensors in electronic communication with the controller, wherein said controller is configured to automatically adjust at least one operating parameter of at least one of the positron emitters and based on data received from the one or more sensors, wherein the at least one operating parameter, when adjusted, affects at least one characteristic of emitted waves selected from the group consisting of: amplitude, magnitude, and frequency.

17. The system of claim 14 further comprising:

a user interface, wherein the data is received from the user interface in response to manual actuation by a user, and wherein said controller is configured to automatically adjust at least one operating parameter of at least one of the positron emitters and the based on additional data received from the user interface.

18. The system of claim 14 wherein:

the positron emitter comprises a housing, a directional chamber positioned adjacent to the housing comprising charged plates, and a hot cell holding radioactive isotopes for generating the positrons located within the housing.

19. The system of claim 14 wherein:

the positron emitter comprises a housing, a directional chamber positioned adjacent to the housing comprising charged plates, and a cyclotron for generating the positrons located within the housing.

20. Ammunition rendered inert by a non-invasive method comprising:

emitting ultrasonic waves by way of one or more ultrasonic emitters toward an area with the ammunition which agitates propellant in the ammunition; and generating and emitting positron waves by way of one or more positron emitters toward the ammunition at the area which bonds at least 75% of carbon atoms in the propellant in the ammunition, wherein at least 95% of the propellant in the ammunition is bonded into a solid mass.

* * * * *